United States Patent [19]

Bloemers

[11] Patent Number: 4,480,605

[45] Date of Patent: Nov. 6, 1984

[54] RECOIL STARTER

[75] Inventor: James L. Bloemers, Fond du Lac, Wis.

[73] Assignee: Brunswick Corporation, Skokie, Ill.

[21] Appl. No.: 492,930

[22] Filed: May 9, 1983

[51] Int. Cl.[3] ..... F02N 1/00

[52] U.S. Cl. ..... 123/185 BA; 123/185 B; 192/36; 192/35; 74/6

[58] Field of Search ..... 123/179 SE, 185 R, 185 A, 123/185 B, 185 BA; 74/6, 7 C; 192/35, 36

[56] References Cited

U.S. PATENT DOCUMENTS

| | | | |
|---|---|---|---|
| 2,338,929 | 1/1944 | Goiot | 123/185 BA |
| 2,460,420 | 2/1949 | Kincannon | 123/185 BA |
| 2,868,186 | 1/1959 | Schnacke | 123/185 BA |
| 3,375,814 | 4/1968 | Hamman | 123/185 R |
| 3,754,543 | 8/1973 | Harkness | 123/185 B |
| 3,827,307 | 8/1974 | Couchman Jr. | 192/36 |
| 4,019,490 | 4/1977 | Reese | 123/185 BA |

*Primary Examiner*—Parshotam S. Lall
*Attorney, Agent, or Firm*—O. T. Sessions

[57] ABSTRACT

A recoil starter mechanism (10) mounted in axial alignment with the flywheel (12) of an internal combustion engine has a drive plate (16) with clutch teeth (34) which moves axially when rotated to engage clutch teeth (17) on the flywheel and rotate the flywheel (12) to start the engine. The drive plate (16) is driven axially and rotationally by ramps (30) on the starter pulley (14) when the starter rope (24) is pulled. A brake plate (18) frictionally engaging the starter housing (13) has arms (37) engaging the drive plate to resist rotation of the drive plate (16), thereby forcing the drive plate to move axially as the starter pulley (14) is rotated.

6 Claims, 3 Drawing Figures

RECOIL STARTER

TECHNICAL FIELD

This invention relates to recoil starters for internal combustion engines and particularly to recoil starters having a clutch face which moves axially to engage the engine drive shaft.

BACKGROUND ART

Prior recoil starters such as those disclosed in U.S. Pat. No. 2,460,420 and No. 2,604,882 have used a dog-type clutch to move axially and engage the engine flywheel to start the engine. These starters have required use of a mechanism to resist the initial turning of the clutch mechanism and provide the required axial engaging motion. The mechanism thus must both slide axially as well as rotationally to accommodate the necessary motion.

DISCLOSURE OF INVENTION

The present invention is particularly directed to a starter mechanism for an internal combustion engine and includes a starter housing having a shaft coaxially aligned with the engine flywheel. A pulley mounted on the starter housing shaft has a ramp facing the flywheel and a drive plate, also mounted for rotation about the starter housing shaft, includes an element constantly engaging the ramp. A brake plate is mounted on the starter housing shaft and frictionally engages the shaft to resist rotation. An element of the brake plate engages the drive plate to resist rotation of the drive plate, thereby causing the ramp on the pulley to force the drive plate axially toward the flywheel when the pulley is turned in a first direction. The brake plate thus moves only in rotation, allowing a very simple friction brake to be used.

The engaging element of the brake plate can be formed as an arm extending axially through a slot in the drive plate to maintain contact between the brake and drive plates as the drive plate moves axially. The engaging arm or arms can be formed with ramps facing the ramp on the pulley to allow limited rotation of the drive plate as it moves axially to engage the flywheel. The limited rotation of the drive plate provides a smoother engagement of the drive plate with the flywheel as well as a smoother sliding action between the drive plate and the engaging arms.

The invention further allows a spring to be compressed between the brake plate and the starter housing shaft to provide a uniform frictional force resisting rotation of the brake plate.

The invention thus provides a highly reliable recoil starter mechanism which can be easily manufactured and assembled and requires a minimum number of parts.

BEST MODE FOR CARRYING OUT THE INVENTION

Figure 1:
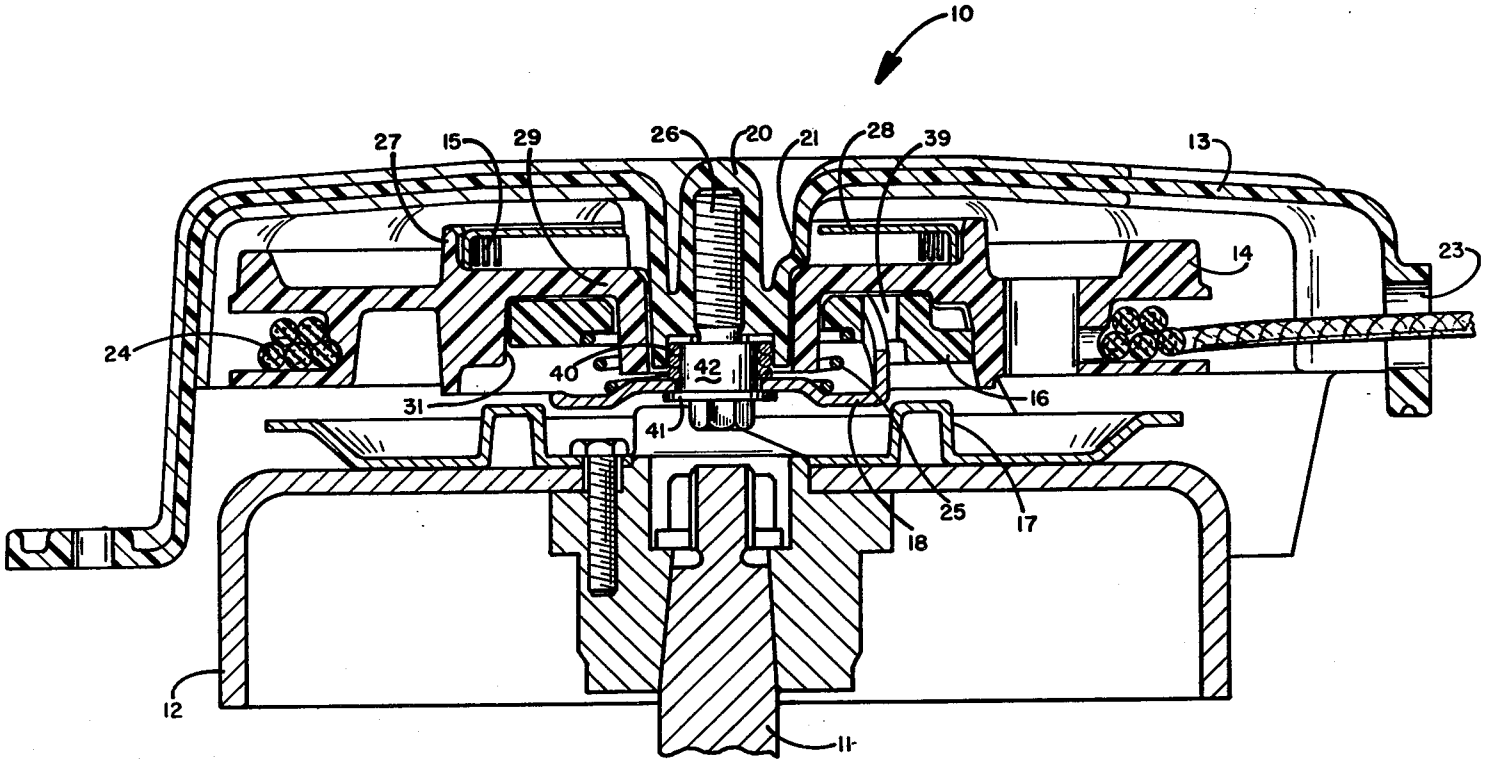
FIG. 1 is a sectional view in elevation showing the starter mechanism of the invention.
Figure 2:
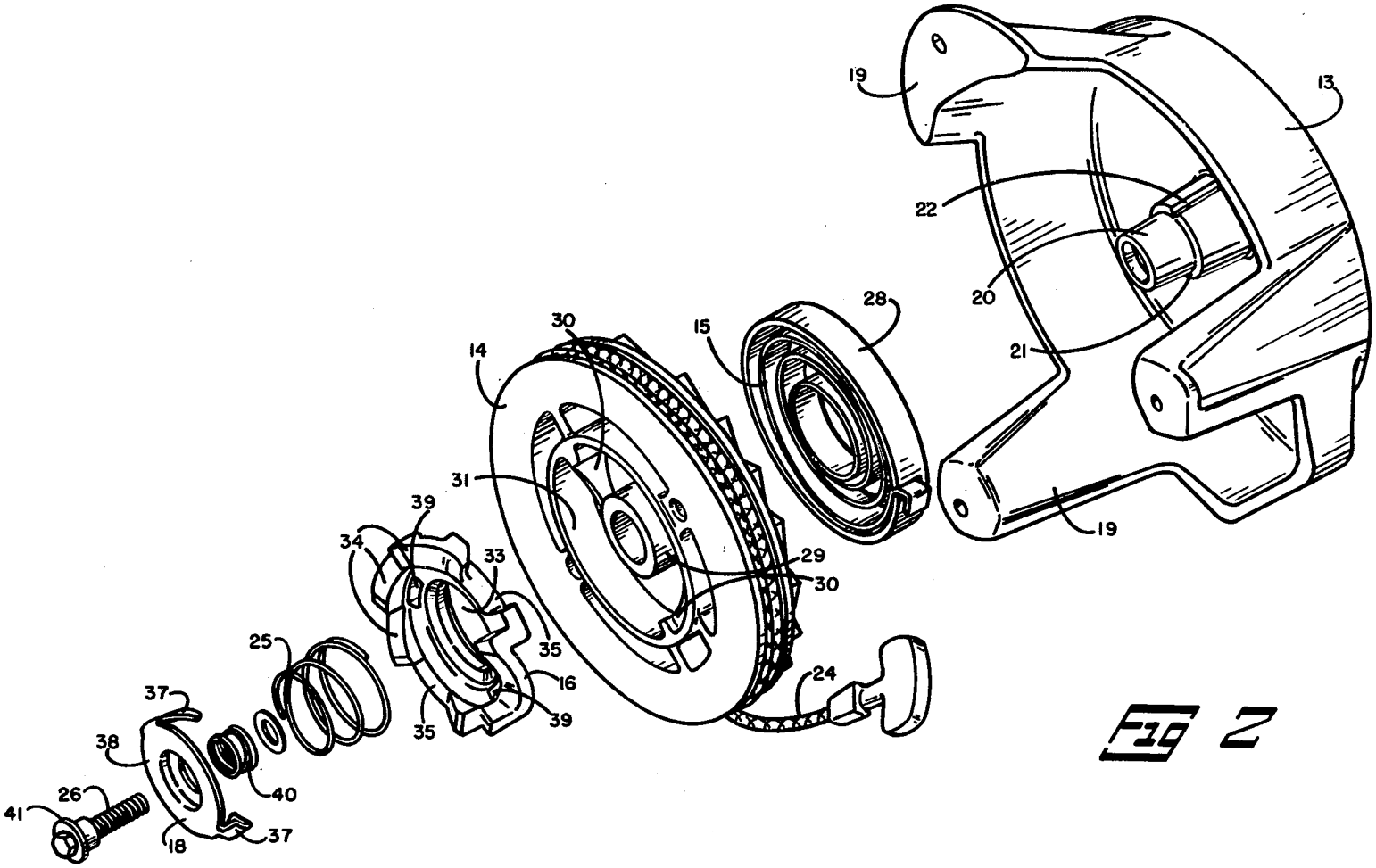
FIG. 2 is an exploded view illustrating the starter assembly.

Referring to the drawings, a recoil starter mechanism 10 for starting an internal combustion engine is illustrated. A portion of the internal combustion engine including an end of the crankshaft 11 to which a flywheel 12 is attached is shown. The starter mechanism 10 is supported on the engine by a starter housing 13 and includes a pulley 14 for actuating the mechanism, a recoil spring 15, a drive plate 16 for engaging the clutch teeth 17 on the flywheel 12, and a brake plate 18.

The starter housing 13 is formed in one piece and includes three legs 19 around its periphery for mounting on the engine. A center post 20, formed integrally with the housing 20, is aligned with the engine crankshaft 11. The center post 20 serves as an axle for the pulley 14, with the portion of the post 20 below the shoulder 21 providing a bearing surface for the pulley 14. Above the shoulder 21 which axially locates the pulley 14, an axial groove 22 is formed along the post 20 to engage the recoil spring 15. The starter housing 13 also includes a guide passage 23 for the pull rope 24.

The starter pulley 14 is mounted to rotate on the bearing portion of the housing post 20 and is held in place axially by a retainer spring 25 which is compressed between the drive plate 16 and the brake plate 18 by a screw 26 engaging the center post 20. The retainer spring 25, in the shape of a conical helix, forces the drive plate 16 against the pulley 14, thus holding the pulley 14 against the shoulder 21. The starter pulley 14 includes an inner rim 27 forming an upward facing cup to house the recoil spring 15 and spring retainer 28. The outer end of the recoil spring 15 is attached to the rim of the spring retainer 28 and the inner end of the spring 15 is engaged with the slot 22 in the housing post 20. The protruding outer end of the recoil spring 15 engages a slot, not illustrated, in the inner rim 27 of the starter pulley 14. The rewind spring 15 thus provides a torsional force on the pulley 14 to rewind the pull rope 24 on the pulley groove when the rope 24 has been extended.

Figure 3:
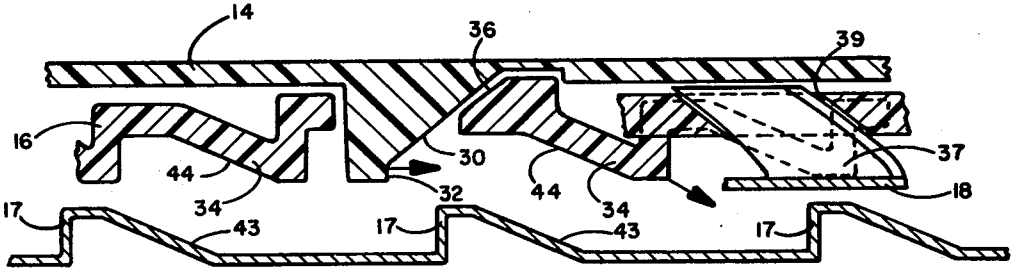
FIG. 3 is a cross-sectional view taken along line 3—of FIG. 1.

An inverted cup is formed on the lower side of the starter pulley 14 to house the drive plate 16. A hub 29 projects downward in the center of the cup and pair of diametrically opposed actuator ramps 30 are formed on the inside walls 31 of the cup to move the drive plate 16 downward, as viewed in FIGS. 1 and 3, as the pulley 14 is rotated. At the end of each ramp 30 an abutment 32 is formed to limit the rotation of the pulley 14 relative to the drive plate 16. The starter pulley 14 can conveniently be injection molded from a suitable plastic such as nylon.

The drive plate 16 is generally circular shaped, having a central hole 33 to fit the outside of the pulley hub 29. A series of downward facing clutch teeth 34, formed around the perimeter of the drive plate 16, have a sloping trailing edge and a vertical leading edge. Two notches 35 are provided opposite each other to accommodate the actuator ramps 30 on the pulley 14. The leading edge of each notch 35 is provided with a surface 36 generally parallel to the surface of the corresponding actuator ramp 30 to allow the surface 30 of the notch 35 to slide along the ramp 30. Preferably the drive plate 16 is molded from glass reinforced nylon.

The brake plate 18 is a stamped metal disk having two arms 37 extending in a helix from the rim of the disk 38, the helical arms 37 extending through holes or slots 39 in the drive plate 16. The brake plate 18 is held in place axially by the screw 26 which engages the center post 20 of the housing 13. A brake spring 40 is compressed between the brake plate 18 and the housing 13 to force the brake plate 18 against the rim 41 of the screw 26. The enlarged shank 42 of the screw 26 seats against the center post 20 to provide a fixed clearance between the brake plate 18 and the center post 20 and a predetermined precompression of the brake spring 40. The brake spring 40 and screw rim 41 thus provide a uniform frictional force resisting rotation of the brake plate 18.

The starter mechanism is made up of parts which can be readily mass produced, primarily by injection molding. Because of the nesting relationship of the components, the mechanism can be readily assembled and disassembled using only a simple wrench. Thus the starter mechanism of the invention is economical to produce and can be readily serviced.

OPERATION

To start the engine, the operator prepares the engine for starting by first appropriately setting the throttle, gear shift, and other related engine controls and then pulling the pull rope 24 to rotate the starter pulley 14. The brake plate 18 is initially held stationary by the brake spring 40 as the pulley 14 begins to turn. As most clearly shown in FIG. 3, rotation of the pulley 14 pushes the actuator ramps 30 on the pulley 14 against the corresponding surface 36 on the drive plate 16. The drive plate 16 is thus forced against the stationary helical arms 37 of the brake plate 18, causing the drive plate 16 to turn and advance along the helical arms 37, moving downward until the abutment 32 on the actuator ramp 30 contacts the drive plate 16. At this point the drive plate 16 begins to rotate with the pulley 14 without slippage. Since the drive plate 16 has been forced downward the clutch teeth 34 on the drive plate 16 engage the clutch teeth 17 on the flywheel 12 and continued rotation of the pulley 14 turns the flywheel 12 to start the engine.

When the engine starts, the flywheel 12 turns faster than the pulley 14 and drive plate 16. The ramps 43 on the leading edge of the flywheel clutch teeth 17 will contact the ramps 44 on the trailing edge of the drive plate clutch teeth 34 to disengage the clutch teeth and force the drive plate 16 upward, as viewed in FIG. 3, toward its initial position. Release of the pull rope 24 will then allow the recoil spring 15 to rotate the pulley 14 in the opposite direction and the retainer spring 25 will return the drive plate 16 to its initial position.

Should the engine not start, the rewind spring 15 will reverse the rotation of the pulley 14 to rewind the pull rope 24 and allow the retainer spring 25 to return the drive plate 16 to its initial position. Thus the starter will be ready for the next attempt to start the engine.

I claim:

1. A starter mechanism for an internal combustion engine having a flywheel, said starter mechanism comprising:

(A) a starter housing mounted on said engine, said housing having a shaft coaxial with said flywheel;

(B) a pulley mounted for rotation on said shaft, said pulley having a ramp facing said flywheel;

(C) a drive plate mounted for rotation about said shaft and free to move axially along said shaft, said drive plate having an element constantly engaging said ramp; and (D) a brake plate mounted on said shaft at a fixed axial position and frictionally engaging said shaft to resist rotation about the axis of said shaft, said brake plate having an element engaging said drive plate to resist rotation of said drive plate while allowing said drive plate to move axially;

whereby when said pulley is rotated in a first direction said drive plate is moved axially along said shaft to engage said flywheel.

2. The starter mechanism defined in claim 1 wherein said drive plate includes a slot and said engaging element of said brake plate includes an arm extending axially through said slot.

3. The starter mechanism defined in claim 2 wherein said axially extending arm includes a ramp facing said ramp on said pulley and facing said flywheel.

4. The starter mechanism defined in claim 3 wherein said arm further includes a ramp facing said pulley.

5. The starter mechanism defined in claim 4 further comprising a brake spring compressed between said brake plate and said starter housing shaft to provide an uniform frictional force resisting rotation of said brake plate.

6. The starter mechanism defined in claim 5 further comprising a retainer spring compressed between said brake plate and said drive plate to normally hold said drive plate out of engagement with said flywheel.

* * * * *